US009033667B2

(12) United States Patent
Iwakiri et al.

(10) Patent No.: US 9,033,667 B2
(45) Date of Patent: May 19, 2015

(54) IMPELLER OF CENTRIFUGAL COMPRESSOR

(75) Inventors: Kenichiro Iwakiri, Tokyo (JP); Isao Tomita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 232 days.

(21) Appl. No.: 13/203,940

(22) PCT Filed: Aug. 10, 2010

(86) PCT No.: PCT/JP2010/063581

§ 371 (c)(1),
(2), (4) Date: Oct. 4, 2011

(87) PCT Pub. No.: WO2011/043125

PCT Pub. Date: Apr. 14, 2011

(65) Prior Publication Data

US 2012/0189454 A1 Jul. 26, 2012

(30) Foreign Application Priority Data

Oct. 7, 2009 (JP) ..... 2009-233183

(51) Int. Cl.
*F04D 29/30* (2006.01)
*F04D 29/28* (2006.01)

(52) U.S. Cl.
CPC ..... *F04D 29/30* (2013.01); *F04D 29/284* (2013.01)

(58) Field of Classification Search
CPC ..... F04D 29/30; F04D 29/284
USPC ..... 416/185, 203, 228, 223 B
See application file for complete search history.

(56) References Cited

U.S. PATENT DOCUMENTS 4,093,401 A * 6/1978 Gravelle ..... 416/185
5,061,154 A * 10/1991 Kington ..... 416/186 R (Continued)

FOREIGN PATENT DOCUMENTS

JP 56-110600 A 9/1981
JP 10-213094 A 11/1998

(Continued)

OTHER PUBLICATIONS

Notice of Allowance for Korean Application No. 10-2011-7019768, dated Oct. 28, 2013, including an English translation.

(Continued)

*Primary Examiner* — Edward Look
*Assistant Examiner* — Danielle M Christensen
(74) *Attorney, Agent, or Firm* — Birch, Stewart, Kolasch & Birch, LLP

(57) ABSTRACT

An impeller of a centrifugal includes, a plurality of full blades provided from the fluid inlet part to the fluid outlet part of the impeller; a plurality of splitter blades provided on the hub surface, wherein the geometry of a flow entering part of the splitter blade is compatible with the complicated flow inside the compressor so that the evenly distributed flow rate distribution, the increased pressure ratio and the enhanced efficiency are achieved. The leading edge blade angle θ in the tip end part of the flow entering front-end-part of the splitter blade 7 in the area of the higher height level from the hub surface is further inclined smoothly toward the blade suction surface side Sb of the full blade 5 in comparison with the inclination standard curve, the increased inclination angle becoming smoothly greater in response to the increase of the height level.

6 Claims, 5 Drawing Sheets

(56) References Cited

U.S. PATENT DOCUMENTS

| | | | |
|---|---|---|---|
| 6,508,626 | B1 | 1/2003 | Sakurai et al. |
| 6,588,485 | B1 | 7/2003 | Decker |
| 2004/0005220 | A1 | 1/2004 | Kawamoto et al. |

FOREIGN PATENT DOCUMENTS

| | | | |
|---|---|---|---|
| JP | 2002-516960 | A | 6/2002 |
| JP | 2002-332992 | A | 11/2002 |
| JP | 2004-52754 | A | 2/2004 |
| JP | 3876195 | B2 | 1/2007 |

OTHER PUBLICATIONS

Decision to Grant a Patent effective Jan. 30, 2014 issued in corresponding Japanese Application No. 2009-233183 with English Translation.

Chinese Notice of Allowance for corresponding Chinese Application No. 201080009428.2 dated May 14, 2014 (with English translation).

* cited by examiner

IMPELLER OF CENTRIFUGAL COMPRESSOR

BACKGROUND OF THE INVENTION

1. Field of the Invention

The present invention relates to the impeller of the centrifugal compressor provided in the turbochargers for vehicle use, marine use and so on; the present invention especially relates to the blade geometry regarding the splitter blade arranged between adjacent full blades, the blade geometry being related to the splitter blade in the area of fluid inlet part.

2. Background of the Invention

The centrifugal compressor used as the compressor part of the turbocharger for vehicle use, marine use and so on gives kinetic energy to the working fluid inhaled in the centrifugal compressor, via the rotational movement of the impeller; further, the centrifugal compressor delivers the fluid outside of the compressor toward the radial direction so as to increase the pressure of the fluid by use of the centrifugal force given to the fluid. It is required that the operating range of the centrifugal compressor be wide enough to keep the high pressure ratio and the high efficiency in the operation range. In order to meet this requirement, the impeller 05 is often provided with the splitter blade 03 between the adjacent full blades 01 in the impeller, as shown in FIG. 9; further, various ideas regarding the blade geometry have been proposed.

As shown in FIG. 9 and FIG. 10 that shows a part of the cross-section along a radial direction in FIG. 9, in the impeller 05 provided with the splitter blades 03, a full blade 01 and a splitter blade 03 are arranged in turn on the surface of the hub 07; in general, the splitter blade 03 is formed by simply cutting the a part of the full blade on the fluid flow upstream side.

As shown in FIG. 11 (that shows an A-A cross-section indicated in FIG. 10), in relation to the general splitter blade 03, the leading edge LE2 of the splitter blade 03 is arranged at a location of a predetermined distance from the leading edge LE1 of the full blade 01, on a downstream side from the leading edge LE1; the trailing edge TE of the splitter blade 03 as well as the full blade 01 is arranged at a location of a predetermined distance from the leading edge LE1 of the full blade 01, the predetermined distance regarding the splitter blade agrees with that regarding the full blade. Thereby, the leading edge blade angle θ (i.e. the angle formed by the axial direction G regarding the impeller and the blade slope direction regarding the splitter blade at the leading edge thereof) of the splitter blade 03 is set so that the direction of the leading edge blade angle θ corresponds to the angles θ of the slopes of the full blades at the leading edge location of the splitter blade (cf. FIG. 2).

However, in the case where the geometrical shape of the splitter blade is simply formed by removing a part on the flow upstream side of the full blade 01 from the whole full blade, there arises a difference between the throat area A1 of the flow passage on the blade pressure surface side Sa of the full blade and the throat area A2 of the flow passage on the blade suction surface side Sb of the full blade; and, the throat area A1 becomes than the throat area A2 (A1<A2). Accordingly, unevenness is developed with regard to both the fluid flows. Thus, there arises the difference between the flow rate of the fluid flow on the blade pressure surface side and the fluid flow on the blade suction surface side; it becomes difficult to evenly impart the fluid flow; it becomes difficult to equalize the blade load for all the full blades as well as all the splitter blades. And the fluid passage dissipation loss in each fluid passage increases; thus, it becomes difficult to improve the impeller efficiency (the compression efficiency regarding the impeller).

Hence, Patent Reference 1 (JP1998-213094) discloses a contrivance in which, as shown in FIG. 12, the leading edge blade angle θ of the splitter blade 09 is increased to an angle (θ+Δθ); namely, the angle θ is increased by an angle increment Δθ toward the flow inlet direction F from the axial direction. In other words, by bringing the leading edge side of the splitter blade close to the blade suction surface side Sb, the throat area A1 of the flow passage on the blade pressure surface side of the full blade is made equal to the throat area A2 of the flow passage on the blade suction surface side of the full blade (A1=A2).

Further, Patent Reference 2 (JP3876195) discloses a contrivance that the flow entering part of the splitter blade 09 is leaned toward the blade suction surface side of the full blade.

In a case where the leading edge blade angle θ of the splitter blade 09 is increased to an angle (θ+Δθ) according to the disclosure of Patent Reference 1 (as depicted by FIG. 12), however, there is apprehension that the fluid flow around the leading edge part where the slope of the splitter blade 09 is increased is separated from the blade; and, there is apprehension that the fluid flow along the blade suction surface side Sb of the full blade is separated from the blade. Further, even when the throat area A1 of the flow passage on the blade pressure surface side of the full blade and the throat area A2 of the flow passage on the blade suction surface side of the full blade are equalized (i.e. A1=A2), the velocity of the flow in one of the flow passages not the same as the velocity of the flow in the other flow passage; thus, it becomes difficult to equalize the flow rate through the one passage and the flow rate through the other passage.

In other words, the flow rate through the one passage becomes different from the flow rate through the other passage; thus, the fluid entering the space between the adjacent full blades 01 is imparted into the two flow passages so that the fluid flow of higher speed mainly streams through the passage on the blade suction surface side; thus, even when the cross section areas of both the flow passages on both the sides of the splitter blade 09 are geometrically equal to each other, the flow rate of the fluid streaming the flow passage on the blade suction surface side becomes greater than the flow rate of the fluid streaming the flow passage on the blade pressure surface side, in response to the increased flow speed increment. Thus, there arises the difference between the flow rate of the fluid flow on the blade pressure surface side and the fluid flow on the blade suction surface side; it becomes difficult to evenly impart the fluid flow; it becomes difficult to equalize the blade load for all the full blades as well as all the splitter blades. And the fluid passage dissipation loss in each fluid passage increases; thus, it becomes difficult to improve the compression efficiency regarding the impeller.

Under the circumstances as described above, Patent Reference 3 (JP2002-332992) discloses another technology. As shown in FIG. 13, according to the disclosure of Patent Reference 3, the leading edge blade angle θ of the splitter blade 11 is unchanged, and the leading edge (part) is expressly shifted toward the blade suction surface side so that throat area A1 is greater than the throat area A2 (i.e. A1>A2). In this way, the technology disclosed by Patent Reference 3 intends to equalize the flow rates of the fluid streaming through both the sides of the splitter blade 11.

REFERENCES

Patent References

Patent Reference 1: JP1998-213094
Patent Reference 2: JP3876195
Patent Reference 3: JP2002-332992

SUMMARY OF THE INVENTION

Subjects to be Solved

However, in any one of the technologies disclosed by Patent References 1 to 3, the improvement in the blade profile is made, in view of the allocation of the flow rates regarding the flow of the fluid streaming through the fluid passages that are imparted by the splitter blades, on a premise that the fluid between the blades streams along (the surfaces of) the full blades; and, the improvement is made not in view of the flow distribution with regard to the flow of the fluid streaming along the splitter blade in the height direction thereof.

Further, the centrifugal compressor is formed with complicated three dimension geometries; thus, strong secondary flows due to Coriolis force, centrifugal force or streamline curvature are generated in the centrifugal compressor; especially, in a case of an open type impeller, the tip clearance leakage flow or the flow caused by the relative movement between the impeller and the casing has an influence on the flow in the compressor; and, the situation of the flow field becomes further complex.

Hence, so long as the conventional blade geometry that is not compatible with the complicated fluid flow inside the compressor is used, it is difficult to desirably constrain the unevenly distributed flow rate and the unevenly distributed pressure on the blade surface. As a result, it is difficult to obtain sufficient performance from conventional impellers.

Hence, in view of the difficulties in the conventional technologies, the subject of the present invention is providing an impeller of a centrifugal compressor, the impeller including, but not limited to:

a plurality of full blades provided from the fluid inlet part to the fluid outlet part of the impeller, each full blade being arranged next to the adjacent full blade;

a plurality of splitter blades provided on the hub surface, each splitter blade being provide between a full blade and the adjacent full blade from a location on a part way of the flow passage between the full blades to the fluid outlet part of the impeller, wherein the geometry of the flow entering part of the splitter blade is compatible with the complicated flow inside the compressor so that the evenly distributed flow rate distribution, the increased pressure ratio and the enhanced efficiency are achieved.

Means to Solve the Subjects

In order to overcome the above-described difficulties in the conventional technologies, the first aspect of the present invention discloses an impeller of a centrifugal compressor, the impeller including, but not limited to:

a plurality of full blades provided on a hub surface from a working fluid inlet part of the impeller to a fluid outlet part of the impeller; and a plurality of splitter blades, each splitter blade being provide between the full blade and the adjacent full blade from a middle of a flow passage formed between the full blades to the fluid outlet part of the impeller, wherein a leading edge blade angle of a flow entering front-end-part of the splitter blade is varied depending on a height level from the hub surface in a height direction of the flow entering front-end-part, further wherein a tip end part of the flow entering front-end-part of the splitter blade is inclined smoothly toward a blade suction surface side of the full blade, at a greater inclination angle than an inclination angle of other part of the flow entering front-end-part.

According to the above-described first aspect of the present invention, in the tip end part of the flow entering front-end-part (equivalent to the leading edge part) of the splitter blade in the area of the higher height level from the hub surface, the leading edge blade angle is further inclined smoothly toward the blade suction surface side of the full blade in comparison with the straight line (or a straight type line H1 in FIG. 7 or a curve) inclination standard by which the leading edge blade angle is defined as a function of the height level, the increased inclination angle becoming smoothly greater in response to the increase of the height level. To be more specific, in the area where the height level is higher than or equal to approximately 70% of the total height level from the hub surface, the tip end part (equivalent to the tip clearance part) of the flow entering front-end-part of the splitter blade is further inclined toward the blade suction surface side of the full blade. In this way, the following effects of the invention can be obtained.

The first effect is that the impeller can be compatible with the tip clearance leakage flow. As shown with the streamlines in FIG. 5 obtained by the numerical computation analysis, in a case of the open type impeller in which there is a clearance between the casing and the blade tip end parts in the direction of the height level from the hub surface, a tip clearance leakage flow W is generated so that the flow W passes through the tip clearance part B on the leading edge side of the full blade; thereby, the flow W streams from the blade pressure surface side of the full blade to the blade suction surface side of the full blade as though the fluid leaks through the clearance. The tip clearance leakage flow accompanies a strong vortex flow (tip clearance leakage vortex); in the neighborhood of the tip end part on the flow entering front-end-part side of the splitter blade, the fluid flow does not stream along the full blade; and, a difficulty happens that a drift flow M is generated.

According to the present invention, however, the tip end part P (cf. FIG. 5) in the area of the higher height level from the hub surface on the flow entering front-end-part side of the splitter blade is inclined toward the blade suction surface side Sb of the full blade; thus, the blade profile can be compatible with the drift flow M that is caused by tip clearance leakage vortex initiated in the neighborhood of the tip clearance part on the leading edge side of the full blade. In this way, the drift flow M can be smoothly fed to the fluid outlet side of the impeller; and, the pressure ratio as well as the efficiency can be enhanced.

The second effect is that the interference between the tip clearance leakage vortex and the tip end part on the leading edge side of the splitter blade can be evaded. The tip clearance leakage vortex is formed as a fluid accumulation area regarding the low energy fluid part; when such a vortex flow is fed toward the tip end part on the flow entering front-end-part side of the splitter blade and interferes with the tip end part on the flow entering front-end-part side of the splitter blade, it becomes a problem that the flow separation as well as the further generated vortex is caused; the dissipation loss regarding the fluid flow is increased and the efficiency regarding the impeller (e.g. compression efficiency) is deteriorated.

According to the present invention, however, in order that the interference between the tip clearance leakage vortex and the tip end part on the flow entering front-end-part side of the splitter blade is prevented, the tip end part on the flow entering front-end-part side of the splitter blade is further inclined toward the blade suction surface side, preferably in the area where the height level is higher than or equal to approximately 70% of the total height level from the hub surface; and, the tip end part is located apart from the central line of the tip clearance leakage vortex. Thus, the impeller efficiency deterioration due to the interference between the vortex and the tip end part can be prevented. In this way, the pressure ratio can be enhanced and the efficiency can be increased.

The third effect is that the surging occurrence can be restrained by changing the situation regarding the pressure field in the fluid flow (namely by constraining the reverse pressure gradient field in the overall flow field). In a centrifugal compressor, the low energy fluid part streaming through the flow field is inclined to stream toward the area of the higher height level from the hub surface so as to be accumulated in the area, because of the effect of the centrifugal forces or Coriolis forces. When the low energy fluid part is brought into the reverse pressure gradient field, the fluid part easily streams in the reverse direction against the main flow direction; and, the low energy fluid part is easily fed from the flow outlet side (the high pressure side) to the flow inlet side (the low pressure side). And, the reverse flow easily becomes a factor causing the surging phenomena regarding the compressor.

As shown in FIG. 3, in the present invention, in the tip end side (the area of higher height level from the hub surface) on the flow entering front-end-part side of the splitter blade, the blade slope is further inclined toward the blade suction surface side of the full blade; the pressure gradient direction (the direction from the higher pressure side toward lower pressure side) expressed by the symbol X in the conventional case (where flow entering front-end-part of the splitter blade is formed as a cutting section of the full blade, and the leading edge blade angle θ corresponds to the angles θ of the slopes of the full blades at the leading edge location of the splitter blade as shown in FIG. 2) is changed into the direction expressed by the symbol Y that is directed so as to come closer to the hoop direction, according to the present invention. Accordingly, in the area of higher height level from the hub surface on the flow entering front-end-part side of the splitter blade, namely, in the neighborhood of the inner surface of the casing, the reverse flow can be constrained, and the surging phenomena that is easily caused by the pressure gradients that are directed from the flow outlet side toward the flow inlet side can be prevented; and, the operation zone (e.g. the operational range in the compressor map) regarding the compressor can be widely expanded.

A preferable embodiment of the above-described disclosure is the impeller of the centrifugal compressor, wherein the tip end part in the height direction of the flow entering front-end-part of the splitter blade is a part formed above a height level which is higher than or equal to approximately 70% of the total height from the hub surface, and further wherein the inclination angle increases gradually up to a prescribed angle from a point above the height level of approximately 70% of the total height towards the tip end part.

According to the above, the inclination angle increment gradually increases while the height level increases up to the tip end where the inclination angle reaches a prescribed angle. Thus, the inclination angle increment gradually increases without sudden change so that the flow separation can be prevented. In addition, the height level of approximately 70% is determined based on the results of the numerical computation analysis that reveals the flow situation around the flow entering front-end-part of the splitter blade, the flow being related to the drift flow caused by the tip clearance leakage flow. Thus, the influence of the tip clearance leakage vortex can be effectively reduced.

In the next place, the second aspect of the present invention discloses an impeller of a centrifugal compressor, the impeller including, but not limited to:

a plurality of full blades provided on a hub surface from a working fluid inlet part of the impeller to a fluid outlet part of the impeller; and a plurality of splitter blades, each splitter blade being provide between the full blade and the adjacent full blade from a middle of a flow passage formed between the full blades to the fluid outlet part of the impeller, wherein a leading edge blade angle of a flow entering front-end-part of the splitter blade is varied depending on a height level from the hub surface in a height direction, further wherein a hub side part of the flow entering front-end-part of the splitter blade is inclined smoothly toward a blade pressure surface side of the full blade, at a greater inclination angle than an inclination angle of other part of the flow entering front-end-part.

In the neighborhood of the hub surface, the low energy fluid part is formed; as shown in FIG. 6 regarding the streamlines which the result of the numerical computation analysis reveals, a part of the low energy fluid part cannot stream toward the outlet side, namely, toward the high pressure downstream side; and, a secondary flow Z is formed so that the flow Z streams from the blade pressure surface side Sa of the full blade to the blade suction surface side Sb of the adjacent full blade.

According to the second aspect of the present invention, in an area Q (in FIG. 6) of lower height level from the hub surface in the flow entering front-end-part of the splitter blade, the leading edge blade angle is made smaller (in the further minus side) than the conventional leading edge blade angle so that the area Q in the neighborhood of the hub surface is inclined further close to the blade pressure surface side Sa of the full blade; in this way, the secondary flow Z that is formed in the area near to the hub surface can smoothly streams toward the fluid outlet of the impeller. As a result, the pressure ratio can be enhanced and the efficiency can be increased.

A preferable embodiment of the above-described disclosure is the impeller of the centrifugal compressor, wherein the hub side part in the height direction of the flow entering front-end-part of the splitter blade is a part formed below a height level which is higher than or equal to approximately 70% of the total height from the hub surface, and further wherein the inclination angle increases gradually up to a prescribed angle from a point below the height level of approximately 70% of the total height towards the hub surface.

According to the above, the inclination angle minus-increment gradually decreases while the height level decreases down to the hub surface where the inclination angle reaches a prescribed angle. Thus, the inclination angle minus-increment gradually decreases without sudden change so that the flow separation can be prevented. In addition, the height level of approximately 70% is determined based on the results of the numerical computation analysis that reveals the flow situation around the flow entering front-end-part of the splitter blade, the flow being related to the drift flow caused by the tip clearance leakage flow and the secondary flow near to the hub surface. Thus, the geometry of the splitter blade according to the present invention can be effectively compatible with the secondary flow.

In the next place, the third aspect of the present invention discloses an impeller of a centrifugal compressor, the impeller including, but not limited to:

a plurality of full blades provided on a hub surface from a working fluid inlet part of the impeller to a fluid outlet part of the impeller; and a plurality of splitter blades, each splitter blade being provide between the full blade and the adjacent full blade from a middle of a flow passage formed between the full blades to the fluid outlet part of the impeller, wherein a leading edge blade angle of a flow entering front-end-part of the splitter blade is varied depending on a height level from the hub surface in a height direction, further wherein a tip end part in the height direction of the flow entering front-end-part of the splitter blade is inclined smoothly toward a blade suction surface side of the full blade, while a hub side part in the height direction of the flow entering front-end-part of the splitter blade is inclined smoothly toward a blade pressure surface side of the full blade.

As described above, the effects according to the third aspect of the present invention include the effects according to the first aspect as well as the second aspect; further, the flow rate of the fluid streaming through the overall fluid passage between a full blade and the adjacent full blade can be evenly distributed into the flow rate of the fluid streaming through the flow passage between the splitter blade and the blade pressure surface side of the full blade and the flow rate of the fluid streaming through the flow passage between the splitter blade and the blade suction surface side of the full blade.

In other words, the tip end part of the flow entering front-end-part of the splitter blade in the area of the higher height level is further inclined toward the blade suction surface side of the full blade; in addition, the hub side part of the flow entering front-end-part of the splitter blade in the area of the lower height level is further inclined toward the blade pressure surface side of the full blade. On the other hand, when the further inclination of the splitter blade is limited to one of the area of the higher height level and the area of the lower height level, there arises a difference between the throat width of the one of the divided flow passage and the throat width of the other flow passage, the overall flow passage being divided by the splitter blade into the divided flow passages. However, the leading edge blade angle of the splitter blade is further inclined in the area of the lower height level as well as the higher height level at the same time, the former inclination (characteristic curve) being directed toward the reverse direction to which the latter inclination (characteristic curve) is directed; thus, the uneven distribution regarding the flow rates of the fluid streaming through the divided flow passages can be eliminated.

Further, it is preferable (i.e. a preferable embodiment of the above-described disclosure) that the tip end part of the flow entering front-end part is a part formed above a height level which is higher than or equal to approximately 70% of the total height from the hub surface, while the hub side part f the flow entering front-end part is a part formed below the height level.

Effects of the Invention

According to the first aspect of the present invention, the leading edge blade angle in the tip end part of the flow entering front-end-part of the splitter blade in the area of the higher height level from the hub surface is further inclined smoothly toward the blade suction surface side of the full blade in comparison with the inclination standard curve by which the leading edge blade angle is defined as a function of the height level, the increased inclination angle becoming smoothly greater in response to the increase of the height level. Thus, the geometry of the splitter blade can be compatible with the tip clearance leakage flow; the drift flow can be smoothly fed toward the flow outlet of the impeller, and, interference between the tip clearance leakage vortex and the splitter blade can be prevented. In this way, the pressure ratio can be enhanced and the efficiency can be increased.

Further, as shown in FIG. 3, the pressure gradient direction (the direction from the higher pressure side toward lower pressure side) expressed by the symbol X in the conventional case is changed into the direction expressed by the symbol Y that is directed so as to come closer to the hoop direction; hence, in the area of higher height level from the hub surface on the flow entering front-end-part side of the splitter blade, namely, in the neighborhood of the inner surface of the casing, the reverse flow can be constrained, and the surging phenomena that is easily caused by the pressure gradients that are directed from the flow outlet side toward the flow inlet side can be prevented; and, the operation zone (e.g. the operational range in the compressor map) regarding the compressor can be widely expanded.

Further, according to the second aspect of the present invention, the leading edge blade angle in the hub side part of the flow entering front-end-part of the splitter blade in the area of the lower height level from the hub surface is further inclined smoothly toward the blade pressure surface side of the full blade in comparison with the inclination standard curve by which the leading edge blade angle is defined as a function of the height level, the decreased inclination angle toward minus side becoming smoothly smaller in response to the decrease of the height level. Thus, the geometry of the splitter blade can be compatible with the secondary flow formed in the neighborhood of the hub surface; the secondary flow formed in the neighborhood of the hub surface can be smoothly fed toward the fluid outlet of the impeller. In this way, the pressure ratio can be enhanced and the efficiency can be increased.

Further, according to the third aspect of the present invention, the tip end part of the flow entering front-end-part of the splitter blade in the area of the higher height level is further inclined toward the blade suction surface side of the full blade; in addition, the hub side part of the flow entering front-end-part of the splitter blade in the area of the lower height level is further inclined toward the blade pressure surface side of the full blade. Thus, the effects brought by this third aspect of the present invention include the effects brought by the first and second aspects according the present invention; in addition to the effects brought by the first and second aspects, the flow rate of the fluid streaming through the overall fluid passage between a full blade and the adjacent full blade can be evenly distributed into the flow rate of the fluid streaming through the flow passage between the splitter blade and the blade pressure surface side of the full blade and the flow rate of the fluid streaming through the flow passage between the splitter blade and the blade suction surface side of the full blade.

As described thus far, the present invention can provide a geometry of the flow entering part of the splitter blade that is compatible with the complicated flow inside the compressor so that the evenly distributed flow rate distribution, the increased pressure ratio and the enhanced efficiency are achieved.

DETAILED DESCRIPTION OF THE PREFERRED MODES

First Mode

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

Figure 1:
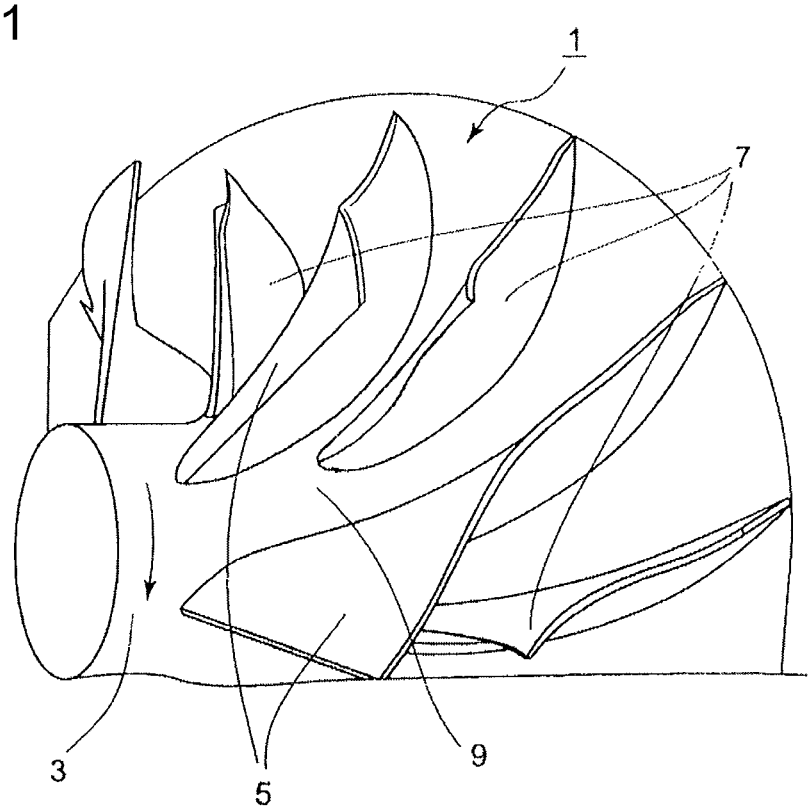
FIG. 1 shows a bird view as to the principal part of an impeller of a centrifugal compressor provided with a plurality of splitter blades according to the present invention.

FIG. 1 shows a bird view as to the principal part of an impeller of a centrifugal compressor to which a plurality of splitter blades according to the present invention is applied. An impeller 1 includes, but not limited to: a plurality of full blades 5 installed upright on a hub 3 that is attached to the rotor shaft (not shown), each full blade being arranged between the adjacent full blades at a constant pitch regarding the hoop direction around the rotor shaft center; and, a plurality of splitter blades 7 installed upright on a hub 3 so that the splitter blade is arranged between a full blade and the adjacent full blade and the splitter blades are arranged symmetrically with regard to the rotor shaft center. Further, the length of the splitter blade 7 is shorter than that of the full blade in the direction regarding the fluid flow; the splitter blade is provided in the fluid flow passage 9 between a pair of adjacent full blades 5 so that the flow entering part of the splitter blade starts on a part way of the fluid passage regarding the fluid flow in the passage 9 and the trailing edge side part of the splitter blade ends at the fluid flow outlet of the impeller.

Figure 2:
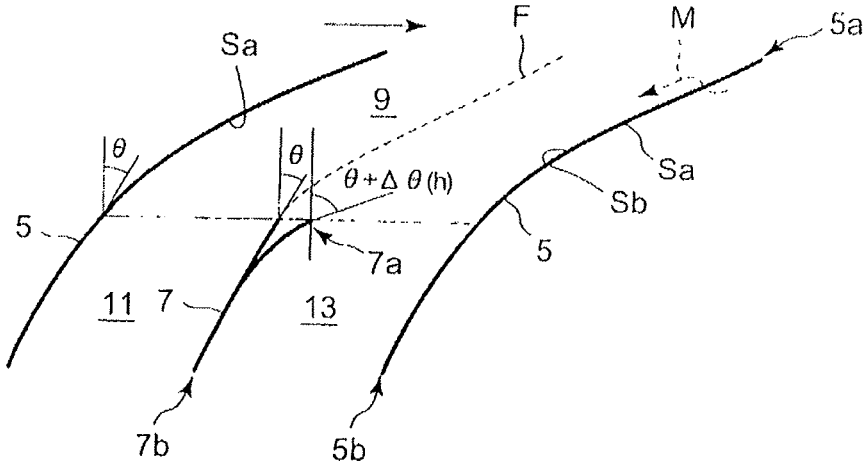
FIG. 2 shows a geometrical relative-relation between a splitter blade and the full blades adjacent to the splitter blade, the relative-relation being related to a first mode of the present invention.
Figure 10:
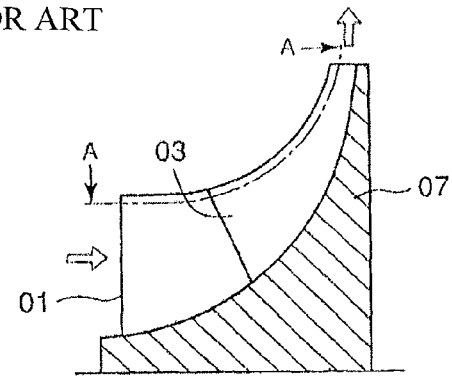
Fig. 10 PRIOR ART
FIG. 10 explains a conventional technology.
Figure 11:
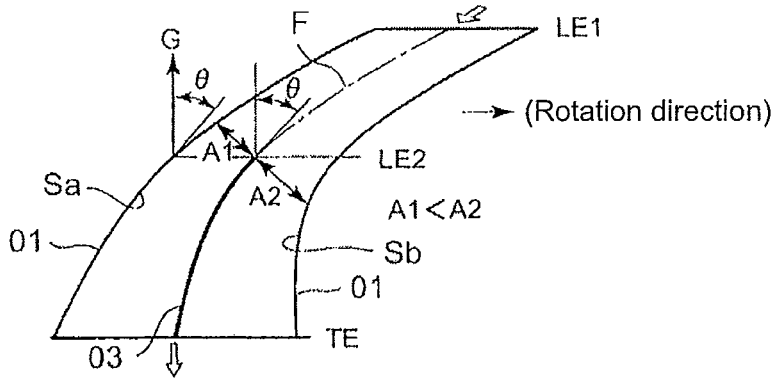
Fig. 11 PRIOR ART
FIG. 11 explains a conventional technology.
Figure 12:
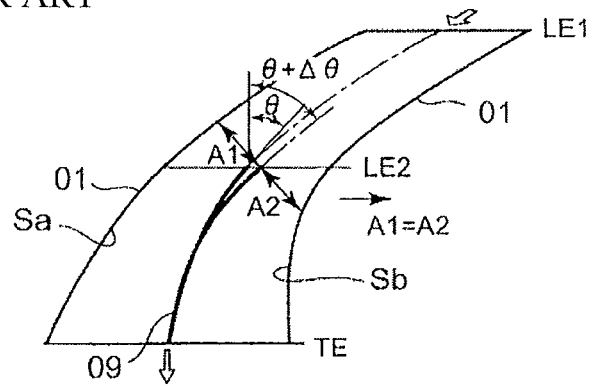
Fig. 12 PRIOR ART
FIG. 12 explains a conventional technology.
Figure 13:
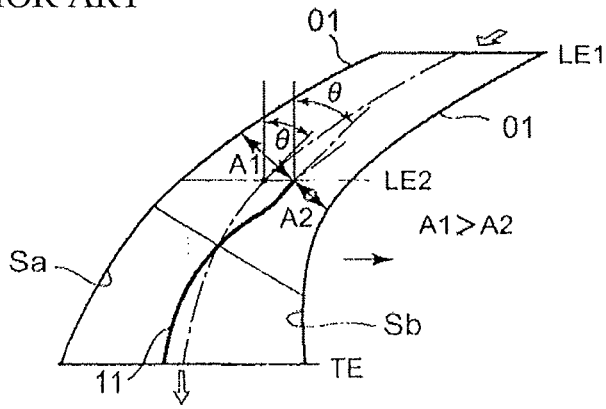
Fig. 13 PRIOR ART
FIG. 13 explains a conventional technology.

In FIG. 2, a geometrical relative-relation between a splitter blade 7 and the full blades 5 adjacent to the splitter blade, the relation being depicted in a cross-section along the longitudinal curved-direction corresponding to the curve A-A in the cross-section of FIG. 10. In addition, the cross-section along the longitudinal curved-direction is placed on the radially outward side, namely, on the casing side (not on the hub side). Incidentally, the arrow in FIG. 2 shows the rotation direction of the impeller 1.

The leading edge 7*a* that is a flow entering front-end-part of the splitter blade 7 is located at the downstream side of the leading edge 5*a* that is a flow entering front-end-part of the full blade 5, the downstream side being in relation to the fluid flow. On the other hand, the trailing edge 7*b* of the splitter blade 7 as and the trailing edge 5*b* of the full blade 5 are coincidentally located on the flow outlet side regarding the impeller.

Further, the splitter blade 7 divides the flow passage 9 formed between a blade pressure surface side Sa of a full blade and a blade suction surface side Sb of an adjacent full blade, into two passages: a flow passage 11 between the surface wall of the blade pressure surface side Sa of the full blade 5 and the splitter blade, as well as, a flow passage 13 between the surface wall of the blade suction surface side Sb of the full blade 5 and the splitter blade.

The above-described impeller 1 is configured as an open type impeller that is housed in a casing (not shown) so that there is a clearance between the impeller and the casing; namely, there are clearances around the outer periphery of the full blades as well as the splitter blades of the impeller. Accordingly, there arises a tip clearance leakage flow W that leaks from a flow passage on the blade pressure surface side of the full blade 5 to the adjacent flow passage on the blade suction surface side of the full blade 5, through the tip clearance between the casing and the tip end part on the leading edge side of the full blade 5.

Figure 5:
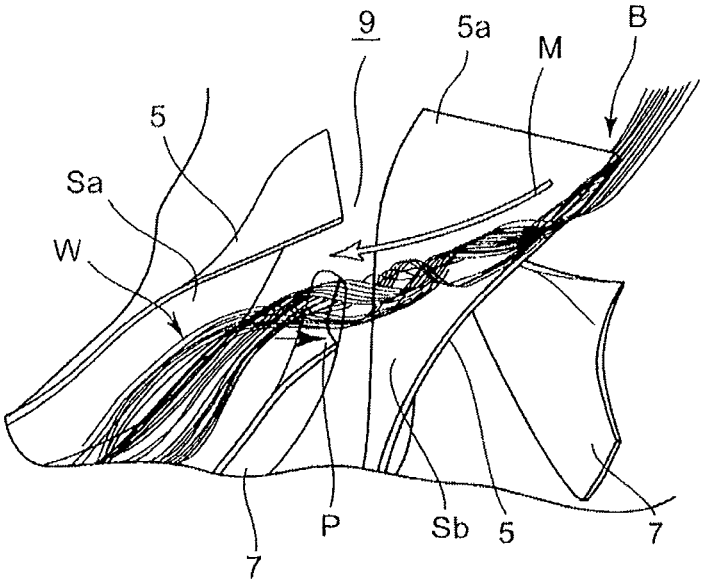
FIG. 5 shows a graphically depicted numerical analysis result regarding a flow that is formed around the tip end part of the flow entering front-end-part of a splitter blade, the flow being a tip clearance leakage flow which comes from the tip end part of a full blade adjacent to the splitter blade.

Since the tip clearance leakage flow W has an effect on the fluid flow at the flow entering front-end-part of the splitter blade 7, a numerical computation analysis is executed so as to evaluate the tip clearance leakage flow W. FIG. 5 shows a graphically depicted numerical analysis result regarding the streamlines of the flow W. A tip clearance leakage flow is observed that passes through a tip clearance part B on the leading edge 5*a* side of the full blade 5. As shown in FIG. 5, the tip clearance leakage flow W accompanies a strong vortex flow (tip clearance leakage vortex) that strongly disturbs the fluid flow along the full blade 5; thus, in the neighborhood of the tip end part on the flow entering front-end-part side of the splitter blade 7, the fluid flow does not stream along the full blade 5. Hence, a difficulty happens that a drift flow M that leaves the tip clearance part B and streams toward the flow entering front-end-part of the splitter blade 7 is caused.

Figure 7:
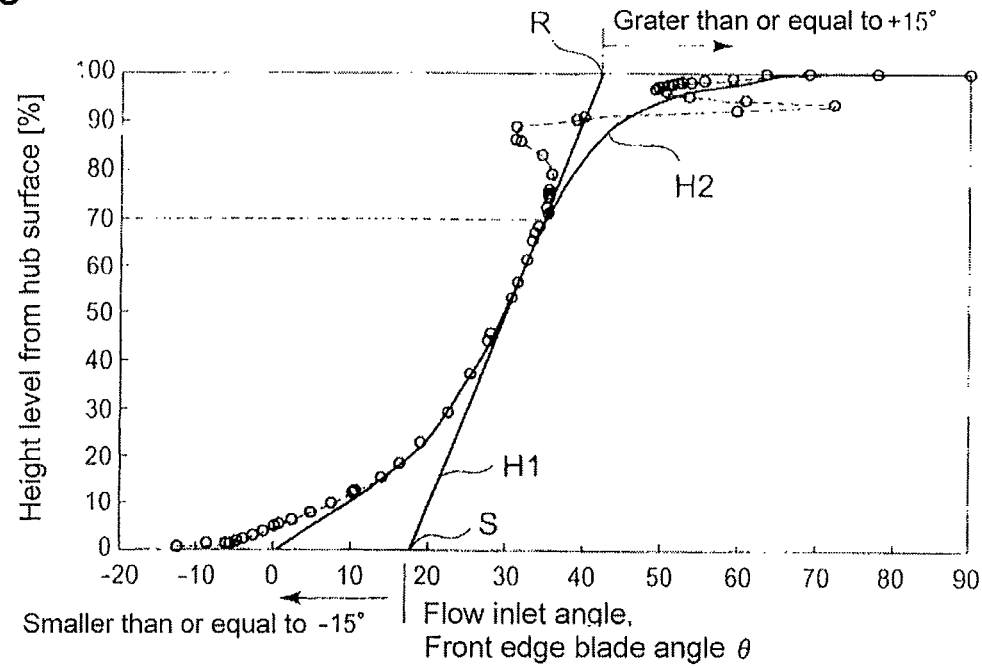
FIG. 7 shows a relation between the height level (%) from the hub surface at the flow entering front-end-part and the leading edge blade angle (θ) as well as a relation between the height level (%) from the hub surface at the flow entering front-end-part and the flow inlet angle based on the numerical computation analysis results.

In order to further investigate the situation of the tip clearance leakage flow W streaming through the passage 9, the inlet angle of the flow of the fluid reaching a part of the leading edge 7*a* of the splitter blade 7 is analyzed by numerical computations; the result thereof is shown by the points of small white circles in FIG. 7; the lateral axis of FIG. 7 denotes the leading edge blade angle (the inlet angle of the flow) θ; the lateral axis coordinates regarding the points of small white circles show the computed flow inlet angle. The vertical axis denotes the height level (the radial direction distance (or span) along the leading edge of the splitter blade 7) from the hub surface (e.g. from a root of the leading edge of the splitter blade 7).

The straight line H1 in FIG. 7 shows the conventional relation between the leading edge blade angle (leading edge blade angle) and the height level, regarding the points on the leading edge of the splitter blade; in a case of the line (the locus) of the conventional leading edge, the leading edge blade angle θ at each height level on the leading edge line regarding the splitter blade 7 is represented by the straight line H1. In other words, along the straight line H1, in the relation between the inlet angle and the height level, the leading edge blade angle θ agrees with the slope angles of the full blade 5 (at the locations corresponding to the points on the leading edge of the splitter blade).

In the area of the middle part of the straight line H1 along the height level, the line H1 approximately agrees with the result of the numerical computation analysis; however, in the area where height level exceeds approximately 70% of the total height, the numerically computed points of small white circles fluctuate in the left or right direction from the line H1 (i.e. the flow inlet angles are reduced or increased). The reason can be attributable to the effect of the vortex movements of the tip clearance leakage flow; in addition, because of the effect of the flow drift regarding the tip clearance leakage flow, the flow inlet angles in the neighborhood of the tip end part deviate, in a meaning of average, from the line H1 toward the right direction (the direction of greater inlet angles).

How far the tip clearance leakage flow W has an effect on the fluid flow around the flow entering front-end-part in the height direction on the tip end part side of the splitter blade 7 so as to disturb the fluid flow (such as the area where height level exceeds approximately 70% of the total height as described above) changes in response to the relative arrangement regarding the splitter blade 7 and the full blade 5. On the other hand, the relative arrangement regarding the splitter blade 7 and the full blade 5 is not so freely changed; for instance, when the splitter blade 7 is arranged against the full blade 5 so that the length (along the tip end curve) of the splitter blade is excessively shorter than or almost the same as the length of the full blade, then the function of the splitter blade is spoiled, and the splitter blade becomes useless. This uselessness can be also ascertained by the numerical calculation analysis regarding the other open type impellers. Thus, it becomes certain that the inlet angles can be effectively inclined in the area where the height level exceeds approximately 70% of the total height.

Hence, according to the numerical computation results, in the area where the span (height level) exceeds approximately 70% of the total span, the line H1 is preferably changed into the curve H2 (in FIG. 7) so that a point (Angle θ, Height level h) on the line H1 is changed into a point (Angle θ+Δθ, Height level h) on the curve H2; whereby, the variable θ and the angle increment Δθ thereof are the function of the height level h. And, the angle increment Δθ(h) is preferably established so that Δθ(h)=θ when the height level h is nearly equal to 70%. Further, the increment Δθ(h) is gradually increased while the height level is increased up to 100%; and, when the height level h reaches 100%, the increment Δθ(h) is preferably set as greater than or equal to approximately 15 degrees. In this way, the present invention establishes the curve H2 as a preferable characteristic curve regarding the leading edge blade angle θ of the splitter blade 7.

Figure 8:
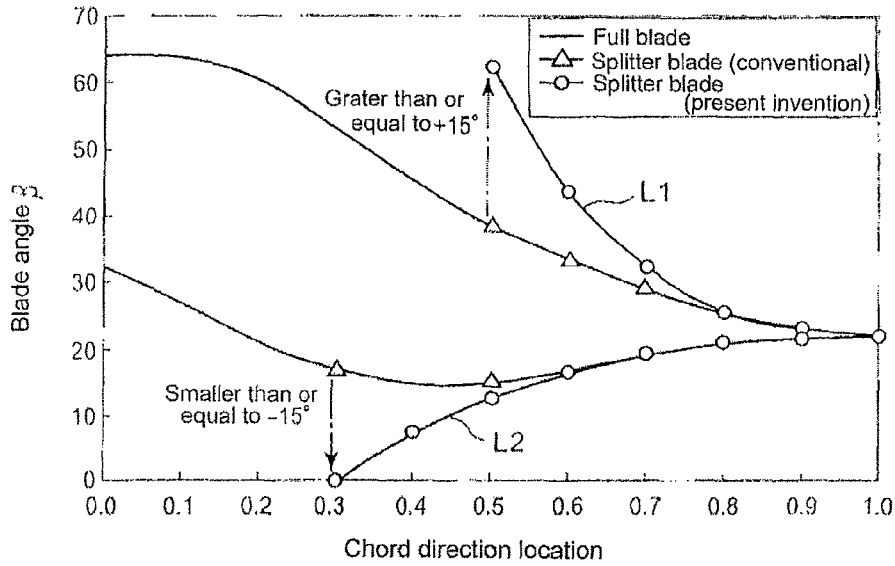
FIG. 8 shows the blade angle (β) as a function of the location along the blade chord direction (the longitudinal direction) with regard to the full blade and the splitter blade.
Figure 9:
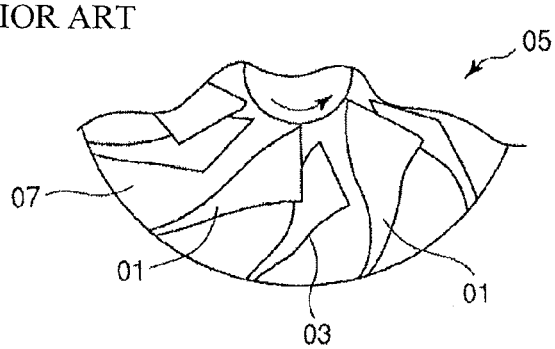
Fig. 9 PRIOR ART
FIG. 9 explains a conventional technology.

FIG. 8 shows the blade angle β as a function of the location along the blade chord direction, namely, the blade longitudinal direction, with regard to the full blade 5 and the splitter blade 7.

In FIG. 8, the vertical axis denotes the blade angle β; the lateral axis denotes the location along the blade chord direction; thereby, the chord length in the lateral coordinate is normalized so that the overall length is equal to 1, and a real number between 0 and 1 corresponds to a location. The zero point on the lateral axis corresponds to the location (of the root) of the leading edge 5*a* of the flow entering front-end-part regarding the full blade 5.

Further, in FIG. 8, the curve L1 shows the function of the location along the splitter blade chord direction, the splitter blade chord being related to the tip end profile of the splitter blade 7. Thus, the blade angle at the tip end on the leading edge of the splitter blade according to the present invention becomes greater by more than or equal to 15 degrees in comparison with the blade angle at tip end on the leading edge of the splitter blade according to the conventional technology. Further, the curve L2 shows the function of the location along the splitter blade chord direction, the splitter blade chord being related to the splitter blade profile along the root of the splitter blade, the root locus being on the hub surface. Thus, the blade angle at the hub surface side end on the leading edge of the splitter blade according to the present invention becomes smaller by less than or equal to −15 degrees in comparison with the blade angle at the hub surface side end on the leading edge of the splitter blade according to the conventional technology. In addition, the curve L1 (on the tip end side) gradually changes toward the trailing edge of the splitter blade 7 so that the blade angle β along the curve L1 approaches the blade angle β along the conventional curve without sudden changes. And, both the angles β agree with each other at the trailing edge. In a similar way, the curve L2 gradually changes toward the trailing edge of the splitter blade 7 so that the blade angle β along the curve L2 (on the hub surface side) approaches the blade angle 13 along conventional curve without sudden changes. And, both the angles β agree with each other at the trailing edge. Further, the blade angle β at the trailing edge 7*b* of the splitter blade 7 agrees with the blade angle β at the trailing edge 7*b* of the full blade 5.

As described above, the blade angle of a part of the splitter blade 7 on the leading edge line (curve) where the height level is higher than or equal to approximately 70% of the overall height is made greater than the blade angle of the corresponding part of the conventional splitter blade; the blade angle at the leading edge of the conventional splitter blade is a linear function of the height level. In the present mode of the invention, the blade angle of the splitter blade 7 on the leading edge line (curve) is gradually increased while the height level advances from the location of approximately 70% to the tip end side of the splitter blade 7. In addition, the blade angle at the tip end on the leading edge line (curve) of the splitter blade 7 is increased by not less than 15 degrees in comparison with the corresponding location (i.e. the point R in FIG. 7) of the conventional splitter blade. The effects of the mode of the present invention are as follows.

The first effect is that the impeller can be compatible with the tip clearance leakage flow. According to the mode of the invention, the blade profile can be compatible with the drift flow M that is caused by tip clearance leakage vortex initiated in the neighborhood of the tip clearance part on the leading edge side of the full blade. Thus, the drift flow M can be smoothly fed to the fluid outlet side of the impeller; and, the pressure ratio as well as the efficiency can be enhanced.

The second effect is that the interference between the tip clearance leakage vortex and the tip end part on the leading edge side of the splitter blade 7 can be evaded. Since the interference between the tip clearance leakage vortex and the tip end part on the leading edge side of the splitter blade 7 can be evaded, the separation of the fluid flow due to the interference as well as the further generation of vortex flows due to the interference can be prevented; thus, the impeller efficiency reduction due to the flow separation as well as the further vortex generation can be prevented. Thus, the pressure ratio as well as the efficiency can be enhanced.

The third effect is that the surging occurrence can be restrained by changing the situation regarding the pressure field in the fluid flow (namely by constraining the reverse pressure gradient field in the overall flow field). In a centrifugal compressor, the low energy fluid part (a low energy fluid mass part or lump of mass) streaming through the flow field is inclined to stream toward the area of the higher height level from the hub surface so as to be accumulated in the area, because of the effect of the centrifugal forces or Coriolis forces; namely, the low energy fluid part is inclined to stream toward the casing inner-surface on the tip end side and accumulate on the tip end side.

Figure 3:
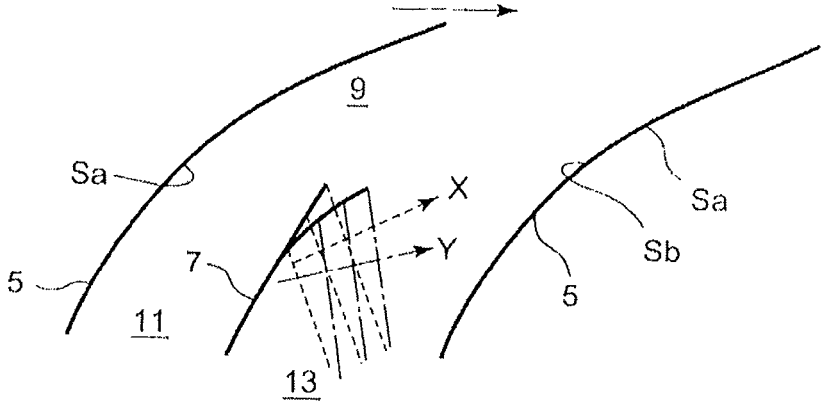
FIG. 3 shows the changes regarding the pressure gradients in the flow field according to the first mode of the present invention.

When the low energy fluid part is brought into the reverse pressure gradient field, the fluid part easily streams in the reverse direction against the main flow direction. Hereby, the reverse pressure gradient field means the fluid flow field in which the fluid flow streams in the direction from the flow outlet side toward the flow inlet side in the impeller; and, the low energy fluid part is easily fed from the flow outlet side (the high pressure side) to the flow inlet side (the low pressure side). And, the reverse flow is a factor causing the surging phenomena regarding the compressor. As shown in FIG. 3, according to the mode of the invention, in the tip end side (the area of higher height level from the hub surface) on the leading edge side of the splitter blade, the blade slope is further inclined toward the blade suction surface side of the full blade; thus, in the conventional cases (where the flow entering front-end-part of the splitter blade is formed as a cutting section of the full blade, and the leading edge blade angle θ corresponds to the angles θ of the slopes of the full blades at the leading edge location of the splitter blade as shown in FIG. 2), the pressure gradient direction (the direction from the higher pressure side toward lower pressure side) is represented by the symbol X. And, according to the mode of the present invention, the direction X is changed into the direction Y that is directed so as to come closer to the hoop direction. Accordingly, in the area of higher height level from the hub surface on the leading edge side of the splitter blade, namely, in the neighborhood of the inner surface of the casing, the reverse flow can be constrained, the surging phenomena that is easily caused by the pressure gradients that are directed from the flow outlet side toward the flow inlet side can be prevented; and, the operation zone (e.g. the operational range in the compressor map) regarding the compressor can be widely expanded.

Second Mode

In the next place, the leading edge blade angle θ in the area of lower height level from the hub surface on the leading edge side of the splitter blade 7 is now explained.

Figure 4:
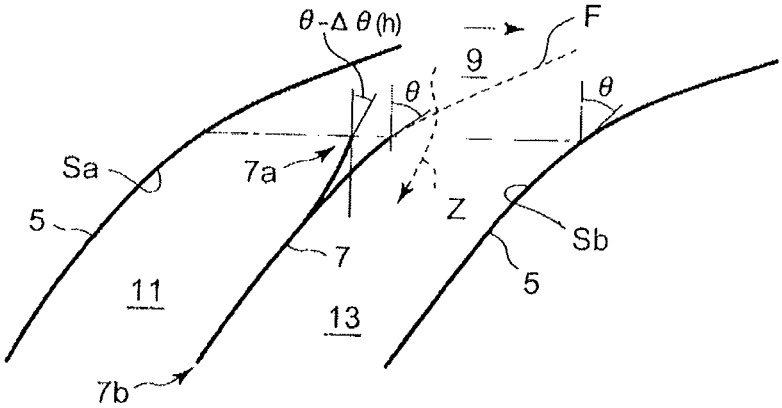
FIG. 4 shows a geometrical relative-relation between a splitter blade and the full blades adjacent to the splitter blade, the relative-relation being related to a second mode of the present invention.

In FIG. 4, the geometrical relative-relation between the splitter blade and the full blades adjacent to the splitter blade is shown, the geometrical relative-relation being depicted in a curved cross-section near to and along the hub surface whereas the curved cross-section in the case of the FIG. 2 is the curved surface along the A-A curve near to the inner casing-surface in FIG. 10. Incidentally, the impeller 1 rotates in the arrow direction.

The fluid streaming in the area near to the hub 3 forms the above-described low energy fluid part; hence, in the flow passage 9 between the adjacent full blades 5, a part of the low energy fluid part cannot stream toward the outlet side, namely, toward the high pressure downstream side; and, a secondary flow Z is formed so that the flow Z streams from the blade pressure surface side Sa of the full blade 5 to the blade suction surface side Sb of the adjacent full blade 5.

Figure 6:
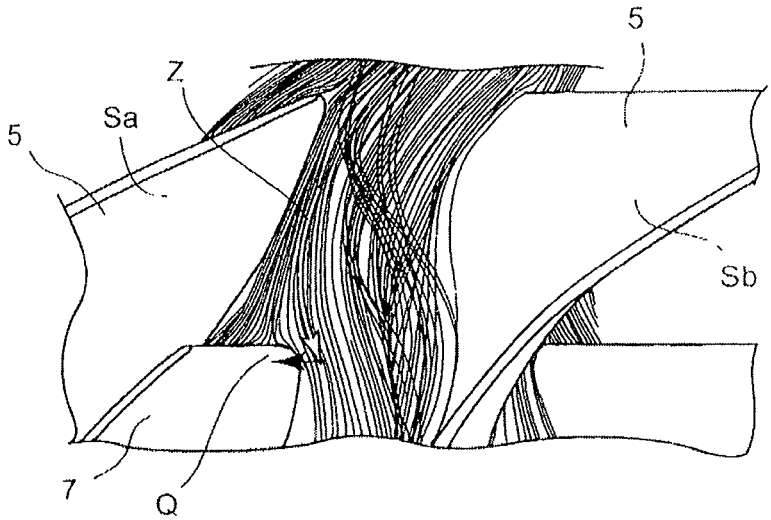
FIG. 6 shows a graphically depicted numerical analysis result regarding a secondary flow that is formed in the neighborhood of the hub surface at the location of the flow entering front-end-part of a splitter blade.

The results of the numerical computation analysis regarding the secondary flow are shown by use of the computed streamlines in FIG. 6; the results of the numerical computation analysis are also shown in FIGS. 7 and 8 that are shown in relation to the first mode of the invention. As shown in FIG. 6, in the fluid flow between the full blades 5, the secondary flow Z is formed so that the flow Z streams from the blade pressure surface side Sa to the blade suction surface side Sb. In the present mode of the invention, in an area Q of lower height level from the hub surface in the flow entering part of the splitter blade 7, the leading edge blade angle is made smaller (in the further minus side) than the conventional leading edge blade angle so that the area Q in the neighborhood of the hub surface is bent further close to the blade pressure surface side Sa of the full blade; in this way, the secondary flow that is formed in the area near to the hub surface can smoothly streams toward the fluid outlet of the impeller.

In the manner as described above, the secondary flow formed in the area near to the hub surface can smoothly stream toward the fluid outlet without being hindered by the splitter blade 7; thus, the pressure ratio as well as the efficiency can be enhanced.

Further, according to FIG. 7 that is used also for the first mode of the invention and shows the results of the numerical computation analysis, the flow inlet angle in the area of lower height level (or span) from the hub surface on the leading edge side of the splitter blade deviates from the straight line H1; namely, the computed result regarding the inlet angles is shown with the points of small white circles on the left side of the straight line H1. In other words, in the area of the height level of lower than or equal to approximately 70%, the computed inlet angles are smaller (in the minus side) than the corresponding leading edge blade angle which the straight line indicates; thereby, the deviation starts at the height level of approximately 70% and the deviation gradually increases while the height level reduces toward the level of the hub surface. In this way, the influence of the secondary flow on the conventional splitter blade can be recognized.

Hence, as shown in FIG. 7, in the area where the span (height level) is shorter than or equal to approximately 70% of the total span, the leading edge blade angle θ of the splitter blade 7 is preferably established so that a point (Angle θ, Height level h) on the line H1 is changed into a point (Angle θ−Δθ, Height level h) on the curve obtained by numerical computation analysis; whereby, the variable θ and the minus angle increment −Δθ thereof are the function of the height level h. And, the minus angle increment −Δθ(h) is preferably established so that −Δθ(h)=0 when the height level h is nearly equal to 70%. Further, the increment Δθ(h) is gradually increased while the height level is decreased down to 0%; and, when the height level h reaches 0%, the increment Δθ(h) is preferably set as greater than or equal to approximately 15 degrees. In this way, the present invention establishes the curve H2 (the curve on the lower side and on the left side of the straight line H1 is named as curve H2) as a preferable characteristic curve regarding the leading edge blade angle θ of the splitter blade 7.

As described above, according to the second mode of the invention, the secondary flow formed in the area near to the hub surface can smoothly stream toward the fluid outlet; thus, the pressure ratio as well as the efficiency can be enhanced.

Further, in the area where the span is shorter than or equal to approximately 70% of the total span, the minus angle increment $-\Delta\theta$ is gradually reduced toward smaller than or equal to −15 degrees; namely, the curve H2 is smooth, and there is no sudden change on the curve H2. Thus, the flow separation due to the sudden change can be prevented.

Third Mode

In the third mode of the invention, both the curve H2 according to the first mode and the curve H2 according to the second mode are adopted; the curve H2 according to the first mode relates to the leading edge blade angle θ in the area of the flow entering front-end-part on the tip end side of the splitter blade 7; the curve H2 according to the second mode relates to the leading edge blade angle θ in the area of the flow entering front-end-part on hub surface side of the splitter blade 7.

As shown in FIG. 7, in the area where the height level is higher than or equal to approximately 70% of the total height level from the hub surface, namely, in the area of the flow entering front-end-part on the tip end side of the splitter blade 7, the leading edge blade angle θ is further inclined toward the blade suction surface side Sb in comparison with the conventional leading edge blade angle θ based on the straight line. The increment $\Delta\theta(h)$ of the leading edge blade angle $\theta(h)$ is gradually increased while the height level h increases from the point of h=approximately 70%; and, at the tip end on the flow entering front-end-part side of the splitter blade 7 (i.e. when the height level becomes equal to 100%), the increment $\Delta\theta(h)$ of the leading edge blade angle $\theta(h)$ is set as greater than or equal to approximately 15 degrees. In other words, the conventional leading edge blade angle θ at the point R in FIG. 7 is further inclined by greater than or equal to approximately 15 degrees, toward the blade suction surface side Sb of the full blade 5; originally, the direction of the leading edge blade angle θ at the point R is related to the flow direction F that is conventionally assumed in the flow field; the leading edge blade angle θ at the point R corresponds to the slope angle of the full blade 5 at the locations corresponding to the points on the leading edge of the splitter blade as shown in FIG. 2; the point R is the upper end point of the straight line H1; and, the leading edge blade angle θ along the straight line H1 agrees with the slope angle of the full blade 5 at the location corresponding to the leading edge of the splitter blade. Thus, the conventional leading edge blade angle θ at the point R is further inclined by greater than or equal to approximately 15 degrees.

Further, in the area where the height level is lower than or equal to approximately 70% of the total height level from the hub surface, namely, in the area of the flow entering front-end-part on the hub surface side of the splitter blade 7, the leading edge blade angle θ is further inclined toward the blade pressure surface side Sa in comparison with the conventional leading edge blade angle θ based on the straight line. The minus increment $\Delta\theta(h)$ of the leading edge blade angle $\theta(h)$ is gradually decreased while the height level h decreases from the point of h=approximately 70% downward; and, at the hub surface on the flow entering front-end-part side of the splitter blade 7 (i.e. when the height level becomes equal to 0%), the minus increment $-\Delta\theta(h)$ of the leading edge blade angle $\theta(h)$ is set as smaller than or equal to approximately −15 degrees. Thus, in the second mode of the invention, the leading edge blade angle $\theta(h)$ of the splitter blade 7 has a curved characteristic of the tip end side and a curved characteristic of the hub side, the former characteristic curve being directed toward the reverse direction to which the latter characteristic curve is directed.

The effects according to the third mode of the invention include the effects according to the first mode as well as the second mode; further, the fluid flow rate through the flow passage 9 is evenly distributed into the flow rate through the flow passage 11 and the flow rate through the flow passage 13, the splitter blade 7 dividing the flow passage 9 into the flow passages 11 and 13.

In other words, according to the third mode of the invention, the tip end part of the flow entering front-end-part of the splitter blade 7 in the area of the higher height level is further inclined toward the blade suction surface side Sb of the full blade 5; in addition; the hub side part of the flow entering front-end-part of the splitter blade 7 in the area of the lower height level is further inclined toward the blade pressure surface side Sa of the full blade 5. On the other hand, when the further inclination of the splitter blade is limited to one of the area of the higher height level and the area of the lower height level, there arises a difference between the throat widths of the flow passages 11 and 13, the splitter blade 7 dividing the flow passage 9 into the flow passages 11 and 13; thus, the fluid flow rate through the flow passage 9 is not evenly distributed into the flow rate through the flow passage 11 and the flow rate through the flow passage 13. According to the third mode of the invention, however, the leading edge blade angle of the splitter blade 7 is further inclined in the area of the lower height level as well as the higher height level at the same time, the former inclination (characteristic curve) being directed toward the reverse direction to which the latter inclination (characteristic curve) is directed; thus, the uneven distribution regarding the flow rates of the fluid streaming through the flow passage 11 and 13 can be eliminated.

INDUSTRIAL APPLICABILITY

The present invention can provide an impeller of a centrifugal compressor, the impeller including, but not limited to: a plurality of full blades provided from the fluid inlet part to the fluid outlet part of the impeller, each full blade being arranged next to the adjacent full blade; a plurality of splitter blades provided on the hub surface, each splitter blade being provide between a full blade and the adjacent full blade from a location on a part way of the flow passage between the full blades to the fluid outlet part of the impeller, wherein the geometry of the flow entering part of the splitter blade is compatible with the complicated flow inside the compressor so that the increased pressure ratio, the enhanced efficiency are achieved and the evenly distributed flow rate distribution can be achieved. Thus, present invention can be suitably applied to the impeller of the centrifugal compressor.

The invention claimed is:

1. An impeller of a centrifugal compressor, the impeller comprising:

a plurality of full blades provided on a hub surface from a working fluid inlet part of the impeller to a fluid outlet part of the impeller; and a plurality of splitter blades, each splitter blade being provide between the full blade and the adjacent full blade from a middle of a flow passage formed between the full blades to the fluid outlet part of the impeller, wherein a leading edge blade angle of a flow entering front-end-part of the splitter blade is varied depending on a height level from the hub surface in a height direction of the flow entering front-end-part, wherein a tip end part of the flow entering front-end-part of the splitter blade is inclined smoothly toward a blade suction surface side of the full blade, at a greater inclination angle than an inclination angle of a part other than the tip end part of the flow entering front-end-part of the splitter blade, and wherein a blade angle at a tip end of the flow entering front-end part of the splitter blade is inclined toward the blade suction surface side of the full blade, at a greater inclination angle than an inclination angle of a tip end of the full blade at a same chord position corresponding to the flow entering front-end-part of the splitter blade.

2. The impeller of the centrifugal compressor according to claim 1, wherein the tip end part in the height direction of the flow entering front-end-part of the splitter blade is a part formed above a height level which is higher than or equal to approximately 70% of the total height from the hub surface, and wherein the inclination angle is configured to increase gradually up to a prescribed angle from a point above the height level of approximately 70% of the total height towards the tip end part.

3. An impeller of a centrifugal compressor, the impeller comprising:

a plurality of full blades provided on a hub surface from a working fluid inlet part of the impeller to a fluid outlet part of the impeller; and a plurality of splitter blades, each splitter blade being provided between the full blade and the adjacent full blade from a middle of a flow passage formed between the full blades to the fluid outlet part of the impeller, wherein a leading edge blade angle of a flow entering front-end-part of the splitter blade is varied depending on a height level from the hub surface in a height direction, wherein a hub side part of the flow entering front-end-part of the splitter blade is inclined smoothly toward a blade pressure surface side of the full blade, at a greater inclination angle than an inclination angle of a part other than the hub side part of the flow entering front-end-part of the splitter blade, and wherein a blade angle at a hub side end of the flow entering front-end-part of the splitter blade is inclined toward the blade suction surface side of the full blade, at a smaller inclination angle than an inclination angle of a hub side end of the full blade at a same chord position corresponding to the flow entering front-end-part of the splitter blade.

4. The impeller of the centrifugal compressor according to claim 3, wherein the hub side part in the height direction of the flow entering front-end-part of the splitter blade is a part formed below a height level which is higher than or equal to approximately 70% of the total height from the hub surface, and wherein the inclination angle is configured to increase gradually up to a prescribed angle from a point below the height level of approximately 70% of the total height towards the hub surface.

5. An impeller of a centrifugal compressor, the impeller comprising:

a plurality of full blades provided on a hub surface from a working fluid inlet part of the impeller to a fluid outlet part of the impeller; and a plurality of splitter blades, each splitter blade being provided between the full blade and the adjacent full blade from a middle of a flow passage formed between the full blades to the fluid outlet part of the impeller, wherein a leading edge blade angle of a flow entering front-end-part of the splitter blade is varied depending on a height level from the hub surface in a height direction, wherein a tip end part in the height direction of the flow entering front-end-part of the splitter blade is inclined smoothly toward a blade suction surface side of the full blade, while a hub side part in the height direction of the flow entering front-end-part of the splitter blade is inclined smoothly toward a blade pressure surface side of the full blade, wherein a blade angle at a tip end of the flow entering front-end-part of the splitter blade is inclined toward the blade suction surface side of the full blade, at a greater inclination angle than an inclination angle of a tip end of the full blade at a same chord position corresponding to the flow entering front-end-part of the splitter blade, and wherein a blade angle at a hub side end of the flow entering front-end-part of the splitter blade is inclined toward the blade suction surface side of the full blade, at a smaller inclination angle than an inclination angel of a hub side end of the full blade at a same chord position corresponding to the flow entering front-end-part of the splitter blade.

6. The impeller of the centrifugal compressor according to claim 5, wherein the tip end part of the flow entering front-end-part is a part formed above a height level which is higher than or equal to approximately 70% of the total height from the hub surface, while the hub side part of the flow entering front-end-part is a part formed at the height level which is less than approximately 70% of the total height from the hub surface.

* * * * *